United States Patent [19]

Theilacker et al.

[11] Patent Number: 5,029,742

[45] Date of Patent: Jul. 9, 1991

[54] WEB PULLING SYSTEM, PARTICULARLY FOR THREADING A PAPER WEB IN A ROTARY PRINTING MACHINE

[75] Inventors: Klaus Theilacker, Friedberg-Rederzhausen; Franz Hillenmayer, Augsburg; Michael Wörner, Neusäss, all of Fed. Rep. of Germany

[73] Assignee: MAN Roland Druckmaschinen AG, Offenbach-am-Main, Fed. Rep. of Germany

[21] Appl. No.: 486,238

[22] Filed: Feb. 28, 1990

[30] Foreign Application Priority Data

Mar. 22, 1989 [DE] Fed. Rep. of Germany ..... 3909470

[51] Int. Cl.[5] ..... B41F 13/02; B65H 23/18

[52] U.S. Cl. ..... 226/92; 226/190; 226/194

[58] Field of Search ..... 226/191, 192, 190, 181, 226/182, 186, 91, 92; 101/228; 100/43, 47, 49; 200/47, 61.41, 61.42, 61.18, 61.13

[56] References Cited

U.S. PATENT DOCUMENTS

| | | | |
|---|---|---|---|
| 3,384,281 | 5/1968 | Mason | 226/100 X |
| 3,995,553 | 12/1976 | Winterholler et al. | 226/92 X |
| 4,111,565 | 9/1978 | Jagger | 226/100 X |
| 4,187,968 | 2/1980 | Winterholler et al. | 226/92 X |
| 4,241,247 | 12/1980 | Byrne et al. | 200/61.41 |
| 4,370,927 | 2/1983 | Fischer | 226/92 X |
| 4,404,907 | 9/1983 | Kobler et al. . | |
| 4,598,850 | 7/1986 | Winterholler et al. | 226/92 |
| 4,821,060 | 4/1989 | Kurths | 226/92 X |

FOREIGN PATENT DOCUMENTS 3505515 9/1986 Fed. Rep. of Germany .

*Primary Examiner*—Daniel P. Stodola
*Assistant Examiner*—P. Bowen
*Attorney, Agent, or Firm*—Frishauf, Holtz, Goodman & Woodward

[57] ABSTRACT

To prevent tooth-to-tooth engagement of an interengaging gear-worm pull-in arrangement for a paper web threading system for a printing machine, a transport sprocket wheel (10) is retained in a movable bearing (16), movable along an angle ($\alpha$) which is an acute angle with respect to the axis of the pull-in element (1,2), and engaged with the pull-in element by a force acting counter the direction of movement of the pull-in element. The transport wheel center is, when engageable with the pull-in element, located along a bisector (19) of an angle ($\beta$), which angle ($\beta$) is defined by a tangent (17*a*) at a first contact point (17) between the transport wheel (10, 10*b*) and the drive wheel (12, 12*b*) and a second tangent line at a second contact point (18) between the pitch circle of the transport wheel (10, 10*b*) and the pull-in element. The bearing of the transport wheel can shift linearly, or along a small arc, the force being generated by the weight of the wheel or by a spring. A suitable angle of deflection for the transport wheel (10, 10*b*) is between 30° and 70°, preferably along a line inclined about 45° with respect to the running direction of the pull-in element.

13 Claims, 2 Drawing Sheets

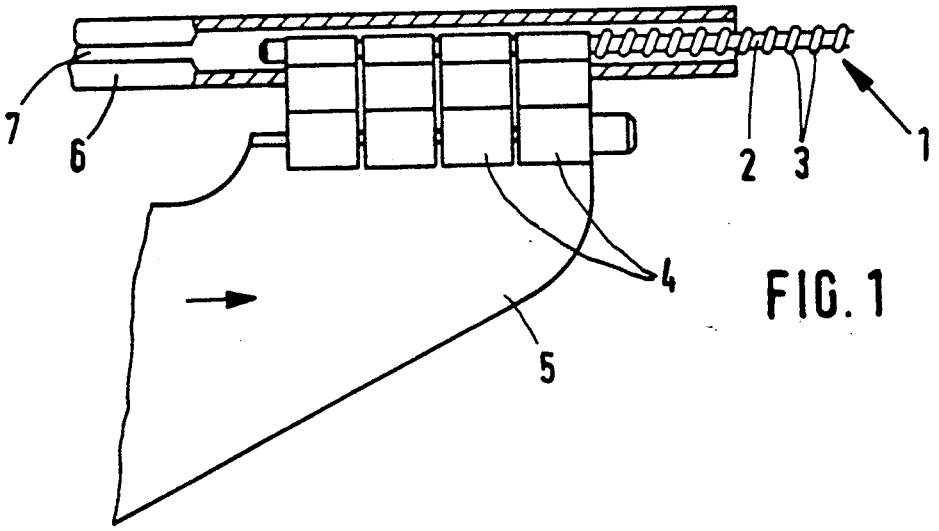
FIG. 1
FIG. 2
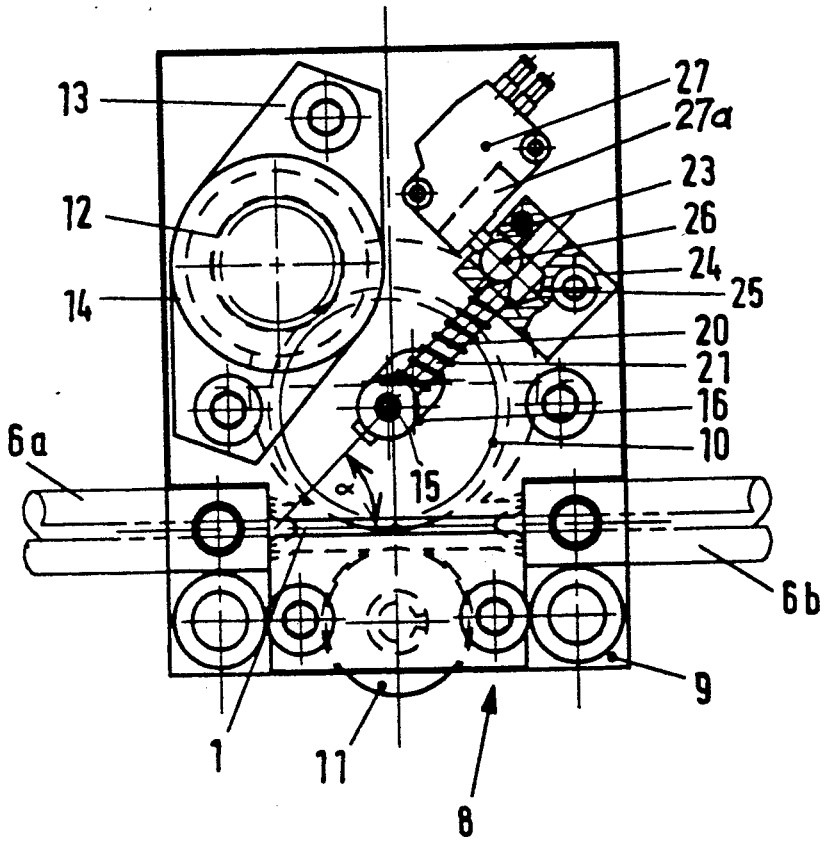

WEB PULLING SYSTEM, PARTICULARLY FOR THREADING A PAPER WEB IN A ROTARY PRINTING MACHINE

Reference to related patents, assigned to the assignee of the present application, the disclosures of which are hereby incorporated by reference:

U.S. Pat. No. 4,187,968, WINTERHOLLER et al

U.S. Pat. No. 4,370,927, FISCHER

U.S. Pat. No. 4,404,907, KOBLER et al

U.S. Pat. No. 4,598,850, WINTERHOLLER et al

Reference to related patent, assigned to the assignee of the present application:

German 35 05 515, Worner.

FIELD OF THE INVENTION

The present invention relates to a system to thread a substrate web into a printing machine, and more particularly to thread a paper web into a substrate printing machine having a threading apparatus with an elongated rod, chain or cable pulled through guideways by pulling motors.

BACKGROUND

U.S. Pat. No. 4,598,850, the disclosure of which is hereby incorporated by reference, as well as German Patent 35 05 515 (to which European EP 192 146 corresponds), all assigned to the assignee of the present application, describe a system in which a pull-in element is driven by a transport wheel which is located for engagement with the pull-in element. In accordance with the disclosure of the aforementioned German Patent 35 05 515, the spacing between the transport wheel and the pull-in element is so selected that the transport wheel extends into the path of the pull-in element. The transport wheel is formed as a sprocket or gear wheel, and the pull-in element is formed either as a chain or has a worm-like pull-in element or pull-on arrangement, to provide for interengaging power transfer engagement between the wheel and the pull-in and pull-on element. A resiliently biassed ball is located below the transport path, extending into the path of the pull-in element which, when the pull-in element is fed into the transport path, is deflected to operate a motor to start driving the pull-in element. Additionally, the ball engages the pull-in element and presses it upwardly to provide for positive interengagement between the teeth of the transport sprocket wheel and the chain gaps or spiral or worm projections on the pull-on element, in dependence on the construction thereof.

The ball is subject to wear and the projecting portions of the pull-on element likewise are subject to wear. When threading paper into a printing machine, it is important that the threading operation is carried out smoothly to prevent sudden jolts being applied to the paper, which might cause the paper to tear. If, due to a fortuitous position of the pull-on element, a gear tooth of the transport wheel happens to meet a projection or chain link of the pull-in portion, jolts have occurred.

THE INVENTION

It is an object to provide a transport system, and more particularly a pull-in station, which is essentially free from wear, and which permits, effectively, engagement of a tooth or gear or sprocket wheel with a pull-in element without causing jolts or jarring.

Briefly, a first tangent of the pitch circle of a first contact point between the transport wheel and a drive wheel, and a second tangent between the pitch circle of the transport wheel and the axis of the elongated pull-in element forms an angle $\beta$; a bisector of said angle $\beta$ forms an acute angle of the value $\beta/2$, which acute angle is inclined counter the direction of movement of the pull-in element towards the transport wheel. The transport wheel is retained in bearings which can deflect away from the pull-in element, in a path along an acute angle $\alpha$ with respect to the axis of the pull-in element. The transport wheel is held against the pull-in element by application of a force F acting counter the direction of movement of the pull-in element, for example by a suitable spring or, if the transport wheel is heavy enough, by gravity acting thereon.

The arrangement of the engagement points of the transport wheel with a drive wheel, which is coupled to a motor and at which point force is applied to the transport wheel, and the engagement point where the force is transmitted to the pull-in element is so selected that the half or bisector of the angles formed by the tangents to the engagement points at the pitch circle of the transport wheel is the acute angle $\beta/2$. Inclining this angle counter the direction of run-in of the pull-in element provides a force acting in the direction of this acute angle $\beta/2$, thereby automatically pulling the transport wheel, in operation, into the wedge-shaped gap, formed by the tangents to the pitch circle. This force increases with the drive force required. Yet, if the situation of tooth-meeting-tooth should occur when the pull-in element first meets the transport wheel, the transport wheel can be easily deflected in opposite direction, out of the wedge-shaped gap. This permits the pull-in element to push the transport wheel easily out of the way and prevent a chattering tooth-to-tooth engagement, and, therefore, provides for smooth jolt or chatter-free feed-in of the pull-in element. Thus, simply and without complicated apparatus, a drive station is provided which, automatically, provides jolt-free interengagement between a gear wheel forming the transport wheel with gaps between projections on the pull-in element, free from tooth-to-tooth engagement.

DRAWINGS

FIG. 1 is a schematic side view of a pull-in element with a holder for a paper web;

FIG. 2 is a front view of a drive station with a transport wheel which can shift along an angular slide path;

DETAILED DESCRIPTION

Figure 3:
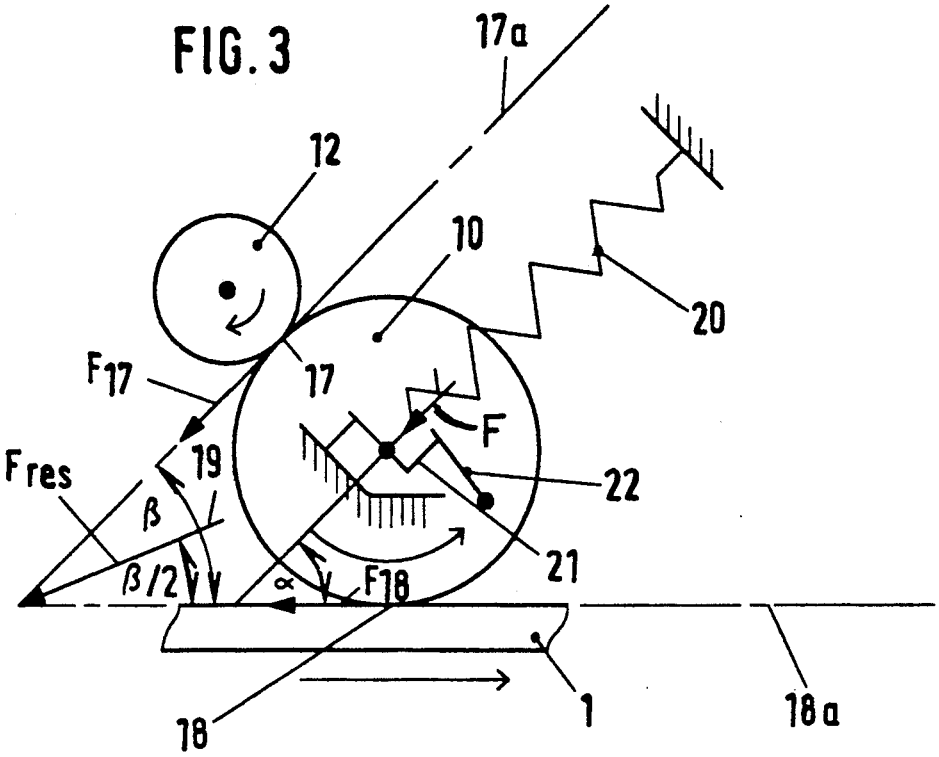
FIG. 3 is a schematic diagram illustrating angular relationships of the principal operating elements.

Printing machines frequently have automatic arrangements to pull in paper webs between the rollers of the printing machines; such arrangements are shown, for example, in the referenced U.S. Pat. No. 4,404,907, the disclosure of which is hereby incorporated by reference, in which a plurality of such pull-in stations are located at predetermined distances along the printing machine. The present invention is specifically directed to such pull-in stations, and to their cooperation with an operative association with paper web pull-in elements.

The pull-in elements are known; they may be flexible cable or rope-like structures of circular or polygonal cross section, with head units which at the outside are formed with a spiral worm to provide interlocking power transmitting engagement of the cable or rope with a gear or sprocket wheel, Chains, and particularly sprocket chains, may also be used. The drive station in accordance with the present invention can be used, in general, for any type of pull-in element which permits interengagement of a sprocket wheel with a pull-in element.

In the example selected, the pull-in element 1 is formed by a cable 2 of circular cross section. A spiral worm or winding 3 is placed on at least a portion of the cable at the circumference thereof, as best seen in FIG. 1. The rear end of the pull-in element 1 has a plurality of attachment clamps 4 placed thereon, to which, in turn, a flexible pulling sheet 5 is secured. The paper web to be pulled or threaded through a printing machine, not shown, is attached to the element 5. The pull-in element 1, together with the cable 2, is guided in an essentially tubular guideway 6 having circular cross section, and being slit on one side with a continuous slit 7 through which the attachment elements 4 can extend. Drive stations 8 are located along the side of the printing machine at suitable distances, one of which is shown in FIG. 2 in detail. The maximum distance between two adjacent drive stations, coupled by the guides 6, is less than the length of the cable or chain to which the pull-in element 1 is attached, so that the cable or chain and thus the pull-in element 1 is coupled at all times with at least one of the drive stations 8.

Each one of the drive stations 8 has a base plate 9 to which the guide 6 is attached, and which supports all other structures necessary for pulling in the paper web. The base plate 9 is attached to a side wall of the printing machine—not shown. The guide 6 is interrupted in the region of the drive station 8 or, alternatively, formed with a cut-out at its upper side in that region to permit engagement of an externally toothed gear or sprocket transport wheel 10 with the pull-in element 1 formed by the spiral cable 2. The guide 6 can be entirely interrupted as shown in FIG. 2. In that case, the two ends 6*a* and 6*b* of the guide element 6 are so secured to the base plate 9 that their longitudinal axes are in alignment. If the guide element is entirely out or interrupted, as shown, a counter roller 11 is located at the bottom to support the pull-in element 1.

The transport sprocket wheel 10 is in engagement with a drive wheel 12 which is coupled to a drive motor 14, secured by a flange 13 to the base plate 9. The motor 14, preferably, is a pneumatic motor. The drive wheel 12 and the guide 6 as well as the counter roller 11, if the latter is provided, are essentially immovably secured to the base plate 9.

In accordance with a feature of the invention, the shaft ends 15 of the transport wheel 10 are located in bearings 16 which can shift with respect to the longitudinal axis of the pull-in element 1, and counter the direction of movement thereof along a path forming an acute angle $\alpha$, and counter a force F, as best seen in FIG. 3.

The forces acting on the transport wheel 10 can be easily determined from the schematic diagram of FIG. 3. Drive force is applied to the transport wheel 10 by the drive wheel 12, derived from motor 14. The drive force is applied to the transport wheel 10 at a common engagement point 17. The transfer of drive energy from the drive wheel 10 to-the pull-in element 1 occurs at the common engagement point 18. The tangents to the pitch circle of the transport wheel 10 are shown at 17*a* and 18*a*. These tangents are identical to the direction of the force vectors representative of forces acting at points 17, 18 on the transport wheel 10. These vectors are shown by the drive force vector $F_{17}$ and the reaction force vector $F_{18}$ of the pull-in element 1. Neglecting friction in the bearing 16, the forces acting on the transport wheel 10 by the force vectors $F_{17}$ and $F_{18}$ are equal; they will form a resulting force $F_{res}$, the vector direction of which extends at the bisector 19 of the angle $\beta$, which is the inclusion angle of the tangents 17*a* and 18*a* to the pitch circle at the engagement points 17, 18.

The drive wheel 12 is so arranged with respect to the transport wheel 10 that the force vector direction 19 will extend at an acute angle counter the running direction of the pull-in element 1. Thus, the resulting force $F_{res}$ acting on the transport wheel 10, in operation, will be in such a direction that the transport wheel 10 is pulled into the wedge-shaped space formed by the tangents 17*a*, 18*a*. The greater the transport force to be transferred, that is, the larger the vectors $F_{17}$, the greater this pull-in or engagement force. In a reverse direction, however, that is, outwardly of the wedge-shaped space, formed by the tangents to the pitch circle, the transport wheel 10 will move easily. Thus, due to the movable positioning of the bearing 16, it can readily deflect or escape outside of the wedge when the pull-in element meets the transport wheel. The force F, which moves the transport wheel 10, is very small. This force need only be large enough to provide for initial engagement of a tooth of the tooth or sprocket transport wheel 10 with the pull-in element 1.

FIGS. 2 and 3 illustrate the force F acting on the bearing 16 of the shaft 15 of the transport wheel 10 applied by a spring 20. If the transport wheel is heavy enough, its weight will be sufficient in order to provide for initial engagement of a tooth of the transport wheel 10 between the gaps of the spiral 3 on the cable 2 of the pull-in element 1. Use of a spring 20 is, however, preferred, since the force can be applied under the acute angle $\alpha$, acting counter the running direction or pull-in direction of the pull-in element 1, when acting on the transport wheel 10. The angle $\alpha$, preferably, is between 30° and 70°, and most desirably at about 45°. In accordance with a preferred feature of the invention, the angles $\alpha$ and $\beta$ are similar. In such an arrangement, the transport wheel 10 is shifted tangentially with respect to the drive wheel 12, thereby readily and most suitably maintaining gear meshing between the wheels 10 and 12.

Deflecting movement of the transport wheel 10 is preferably initiated and caused by a pull-in element being pushed from a preceding drive station 8 into the next drive station. This deflection of the transport wheel 10, in accordance with a feature of the invention, can then be used to start the motor 14. A switch element 21, see FIGS. 2 and 3, is operatively coupled to the bearing 16 of the transport wheel 10 which, upon shift of the transport wheel 10, causes operation of a switch 22, as schematically shown in FIG. 3. In an actual and suitable structure, as shown in FIG. 2, the switch element 21 is a bolt which is supported at one end on the bearing 16. The other end is conically ground and placed within a bore 23 of a switch housing 24. The shaft of the bolt 23 is used, at the same time, to guide the spring 20, formed as a spiral spring and surrounding the bolt with slight clearance. The switch housing 24 is formed with a blind bore 25, located at right angles to the bore 23. A ball 26 is located within the blind bore 25, and in engagement with the conical end of the bolt 21. Upon shift of the transport wheel 10, the ball 26 is pressed by the bolt 21 in the bore 25, to thereby operate a pneumatic switch 27 which operates the motor 14. To reduce the necessary switching forces, a pneumatic amplifier, schematically shown at 27*a*, can be interposed between the pneumatic ducts controlled by the ball 26 and actual pneumatic switch which, in turn, controls the pneumatic motor 14.

OPERATION

When the transport wheel 10 is deflected from its quiescent position counter the force F, as above explained, motor 14 will start, causing rotation of the drive wheel 12, and hence of the transport wheel 10, coupled to the drive wheel 12. The entire drive station 8, in the running direction or moving direction of the pull-in element 1, from left to right, and with respect to FIG. 2, as schematically shown by the arrows in FIGS. 1, 3, 4 and 5, acts like a free wheel drive or an overrun or overriding clutch. So long as the pull-in element 1 is pushed by a preceding drive station, or as soon as it is engaged and pulled by a subsequent drive station, the transport wheel 10 can deflect in a direction along the angle $\alpha$ and yield at an inclination towards the right, and upwardly, with reference to FIG. 3. As soon as the drive force of the driving station 8 becomes effective, that is, when the motor 14 has reached speed, gear-like interengagement between the transport wheel 10 and the pull-in element 1 will be maintained based on the above-described resulting force $F_{res}$.

Figure 4:
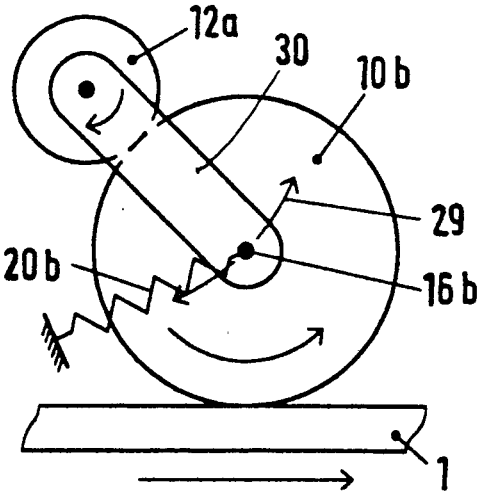
FIG. 4 is a schematic fragmentary view illustrating a pivotably movable transport wheel.
Figure 5:
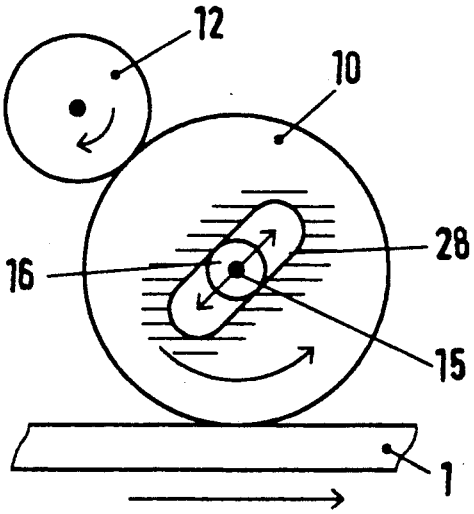
FIG. 5 is a schematic fragmentary view illustrating another arrangement to place a transport wheel in angular, movable position.

Various arrangement can be used to permit deflection of the transport wheel 10 from engagement position, and pull-in of the transport wheel 10 towards the apex of the wedge-shaped region defined between the tangents 17, 18. FIG. 5 illustrates an arrangement in which the transport wheel 10 has its shaft positioned within an elongated guide slot 28. The angle $\alpha$ remains unchanged. It is, of course, also possible to support the transport wheel 10 by a link element 30, pivotably secured to a shaft stub pivotable about the axis of rotation of the drive wheel 10*b*, as seen in FIG. 4. In this arrangement, the transport wheel 10*b* will move in an arcuate path 29 about the axis of rotation of the drive wheel 10*b*. The angle will vary slightly as the drive wheel 10*b* pivots, this slight variation, however, not materially changing the above-discussed force relationships. The transport wheel 10*b*, as seen in FIG. 4, is secured to the pivotable link 30, pivotable about the axis of the drive wheel 12*b*, and maintained in engagement with the pull-in element 1, moving in the direction of the arrows beneath the element 1 as shown in FIGS. 3, 4 and 5. The spring 20*b* applies an engagement force analogous to that of the spring 20, FIG. 3, in the direction of the wedge defined by the tangents to the pitch circle of the transport wheel 12.

Various changes and modifications may be made, and any features described herein may be used with any of the others, within the scope of the inventive concept.

We claim:

1. In a web pulling system, particularly for threading a paper web through a rotary printing machine, an elongated chain or cable-like pull-in element (2, 3);

a transport wheel (10) engageable with said pull-in element when the pull-in element moves towards said transport wheel, said transport wheel having shaft ends (15);

said transport wheel (10) and said pull-in element (2, 3) being respectively formed with interengaging means (3);

a drive wheel (12) surface-coupled to said transport wheel; and motor means (14) driving said drive wheel;

wherein, in accordance with the invention, a first tangent (17*a*) to the pitch circle of a first contact point (17) between the transport wheel (10, 10*b*) and the drive wheel (12, 12*b*) with a second tangent line (18*a*) at a second contact point (18) between the transport wheel (10, 10*b*) and the elongated pull-in element defines an angle ($\beta$) and a bisector of said angle ($\beta$) forms an acute angle ($\beta/2$) which is inclined counter the direction of movement of said pull-in element towards the transport wheel (10); and wherein support means (16, 28, 30) are provided, for movably supporting said shaft ends (15) of said transport wheel (10, 10*b*) and placing the transport wheel in position for engagement by and with the pull-in element (1, 2), said support means permitting movement of the shaft ends (15) and deflection of the transport wheel (10, 106) essentially in a direction forming an acute angle ($\alpha$) with respect to the axis of said pull-in element, said transport wheel being engaged against said pull-in element by a force (F) acting counter the direction of movement of the pull-in element.

2. The system of claim 1, including switch means (27) coupled to activate said motor means (14), and coupling means (21) operatively coupled to said transport wheel and sensing deflection of said transport wheel (10, 10*b*) upon engagement of the transport wheel with a pull-in element, said coupling means operating said switch means.

3. The system of claim 2, wherein said coupling means comprises a coupling element (21) sensing deflection of the shaft ends.

4. The system of claim 1, including a spring (20, 20*b*) operatively coupled to said transport wheel (10) and providing said force (F) acting counter the direction of movement of the pull-in element.

5. The system of claim 1, wherein said support means (16) supporting said shaft ends of the transport wheel include means (28) guiding the shaft ends in a straight line.

6. The system of claim 1, including means (28) guiding movement of the transport wheel in a predetermined path.

7. The system of claim 6, wherein said predetermined path is in a straight line direction.

8. The system of claim 1, wherein said acute angle ($\alpha$) has a value of between 30° and 70°.

9. The system of claim 1, wherein said acute angle ($\alpha$) is approximately 45°.

10. The system of claim 1, wherein the angles ($\beta$) and ($\alpha$) are at least approximately equal.

11. The system of claim 1, wherein said support means supporting said shaft ends of the transport wheel (10*b*) include means (30) guiding the shaft ends in an arc (29) having an arc axis concentric with the axis of said drive wheel (12*b*).

12. The system of claim 11, wherein said support means include link means (30) pivotable about the axis of rotation of said drive wheel (12) and supporting said said transport wheel (10*b*).

13. The system of claim 1, wherein said motor means (14) comprises a pneumatic motor;

switch means (27) are provided, operatively coupled to said motor, and further operatively coupled to said transport wheel (10) for operation upon movement of the shaft ends (15) of said transport wheel; and a pneumatic amplifier (27*a*) interposed between said pneumatic motor and said pneumatic switch means for reducing the switching force required to operate said pneumatic switch.

* * * * *